US006050366A

United States Patent [19]

Lyons

[11] Patent Number: 6,050,366

[45] Date of Patent: Apr. 18, 2000

[54] COMBINED STAIRWAY AND LIFT INSTALLATION AND A RETRACTABLE STAIRWAY

[75] Inventor: Charles Thomas Lyons, Colnbrooke, United Kingdom

[73] Assignee: Hydraulic Technical Services (Consultants) Ltd., United Kingdom

[21] Appl. No.: 09/232,143

[22] Filed: Jan. 15, 1999

Related U.S. Application Data

[63] Continuation of application No. PCT/GB97/01931, Jul. 14, 1997.

[30] Foreign Application Priority Data

Jul. 15, 1999 [GB] United Kingdom ..... 9614868

[51] Int. Cl.[7] ..... B66B 9/08

[52] U.S. Cl. ..... 187/200; 187/254; 187/266; 414/921

[58] Field of Search ..... 187/200, 254, 187/266; 414/921, 787; 52/9, 67; 105/449; 280/166; 182/62.5, 88, 101, 141, 222, 223

[56] References Cited

U.S. PATENT DOCUMENTS

| | | | |
|---|---|---|---|
| 3,400,502 | 9/1968 | Scaggs et al. . | |
| 3,488,898 | 1/1970 | Scaggs . | |
| 3,906,690 | 9/1975 | Miriani | 182/88 |
| 4,457,402 | 7/1984 | Del Vecchio et al. . | |
| 5,234,078 | 8/1993 | Smith | 414/921 |
| 5,375,962 | 12/1994 | Kempf | 414/921 |

FOREIGN PATENT DOCUMENTS

| | | | |
|---|---|---|---|
| 0316182 | 5/1989 | European Pat. Off. . | |
| 0 337 592 | 10/1989 | European Pat. Off. | 52/9 |
| 0780335 | 10/1996 | European Pat. Off. . | |
| 2083277 | 12/1971 | France . | |
| 2723578 | 7/1996 | France . | |
| 2935440 | 3/1981 | Germany . | |
| 3318400 | 11/1984 | Germany . | |
| 404073370 | 3/1992 | Japan | 182/62.5 |
| 2105398 | 3/1983 | United Kingdom . | |

*Primary Examiner*—Robert P. Olszewski
*Assistant Examiner*—Steven B. McAllister
*Attorney, Agent, or Firm*—Clifford W. Browning; Woodard, Emhardt, Naughton, Moriarty & McNett, Patent and Trademark Attorneys

[57] ABSTRACT

A combined stairway and lift installation has a stairway which comprises a stack of horizontally movable step members whereby the stairway is retractable to expose a lift which is installed in a cavity which is covered by the stairway when the latter is extended. Uncovering of the lift allows it to be operated to raise its load carrying platform to the level of the top of the stairway. A chain is anchored by either end in the bottom step member. The chain is led from the anchorage up through the step members, alternately clockwise and counter clockwise around guide rollers mounted in each of the movable step members, clockwise around a guide roller and a motor-driven cog wheel in the top step member, and back down through the movable step members to the other anchorage again alternately clockwise and counter clockwise around further guide rollers mounted in each of the movable step members. The motor is reversible so that in one sense it drives the movable step members to form the stairway and in the other sense it drives them to their retracted position.

13 Claims, 4 Drawing Sheets

17
26
23
27
34
35
24
31
33
28
27
29
25
34

55
53
51
56
54
42
42
37
52
42
43
39
16
57
49
48
45
47
58
42
51
42
52
61
46
44
45
59
41
38
42
36
47
62
46

COMBINED STAIRWAY AND LIFT INSTALLATION AND A RETRACTABLE STAIRWAY

This application is a continuation of international application number PCT GB97/01931, filed Jul. 14, 1997, (pending).

BACKGROUND OF THE INVENTION

This invention relates to a combined stairway and lift installation and to a retractable stairway.

U.S. Pat. No. 4,457,402 discloses a wheelchair lift which includes an elevator platform and a plurality of vertically movable stair members. When the platform is in its lower position, the stair members form a stairway, and, when the platform is raised, the stair members are moved upwardly until they and the platform are coplanar with the upper surface to which the stairway led. This arrangement occupies space which is the combined platform area of the lift platform and the stairway. In certain installations, space is limited and sufficient space may be unavailable.

SUMMARY OF THE INVENTION

GB-A-2105398 discloses an extendible ladder or crane which has two separate rope systems. A first rope system consists of a loop on each intermediate ladder section and attached to the adjacent ladder sections so as to ensure synchronism of the relative movement of those ladder sections.

The second rope system consists of an extending rope zig-zagging up the ladder section which is moved differently with respect to a retracting rope which extends directly to the uppermost section. This arrangement would suffer from slackness in the rope at certain stages of operation of the system if a single rope was used for the two rope system.

DE-A-2935440 discloses a telescopic platform comprising movable platform stages rising from front to back, each platform stage comprising a bench and a passageway. The telescopic platform is provided with a continuous elongate flexible member in the form of a chain which is turned back in the opposite direction several times round guide rollers which are mounted in pairs on each platform stage. Extension and contraction of the telescopic platform is effected by driving two of the guide rollers in the opposite sense, the two rollers being on either side of a central loop which cooperates with a tensioning device. This reversible continuous drive mechanism is complicated. It requires two pairs of rollers on all but the lowest platform stage, as well as the means operable to drive the two driven rollers in the opposite sense.

An object of this invention is to provide a combined stairway and lift installation which does not require so much floor apace at the foot of the stairway.

According to one aspect of the invention, a combined stairway and lift installation comprises movable step members which are arranged to form a stairway when the lift is at one level and which are movable into another configuration when the lift is operated to be at another level. The stairway is formed over the lift when the lift is lowered and the step members are movable horizontally to and from their other, retracted configuration in which they are displaced to one side of the lift so that it is exposed and free to be raised. In the preferred embodiment the lift is installed in a cavity at the one level. Each movable step member has a front and rear and the length of the step members from their front to their rear may be the same so that their front portions are flush in the other retracted configuration. Each movable step member may have guide members mounted in it. An elongate flexible member may be anchored at either end in one of the movable step members, the flexible member being led from one of those anchorages through each movable step member in turn, being guided round at least one guide member on each step member alternately clockwise and anti-clockwise round each successive guide member and then being led back through each movable step member to the other anchorage, being guided around at least one other guide member on each step member alternately clockwise and anti-clockwise round each successive other guide member. Reversible driving means may be provided for exerting a pull on the elongate flexible member in either direction, the arrangement being such that, when the step members form the stairway and the elongate flexible member is driven in one sense, the step members will be moved to the other retracted configuration, whereas, when the step members are in that other retracted configuration and the elongate flexible member is driven in the opposite sense, the step members will be moved to form the stairway. The guide members which guide the enlongate flexible member as it emerges from one of the step members and enters the adjacent step member may be arranged so that it follows a substantially horizontal path in so doing. Each step member other than the top step member, may have front, side and rear walls which form a rectangle, the front wall serving as a riser portion of the respective step when the stairway is formed and a part of the top which extends rearwards from the front being covered by a panel which serves as a tread portion of the respective step when the stairway is formed, the remainder of the top of the rectangle extending from the panel to the rear wall being open, and wherein each guide member mounted within the step member is mounted below the open remainder of the top. The guide members for the elongate flexible member that are mounted in each step member other than the bottom one, may comprise two pairs arranged one pair above the other, the lower pair being between the upper pair when viewed from above. The elongate flexible member is one of a pair of such elongate flexible members, the other elongate flexible member being similarly anchored at either end and being similarly led and guided through each movable step member. Common reversible driving means may be provided for exerting a pull on both the elongate flexible members in either direction. The reversible driving means may comprise a motor, the or each elongate flexible member may comprise a chain and one of the guide members for the or each chain may comprise a cog wheel which meshes with the respective chain, the motor being operable to drive the or each cog wheel. The cog wheel for each chain may be mounted on a common axle which is drivingly coupled with the motor through a separate drive belt. Each step member may have side walls which form horizontal trackways which extend over a major part of the length of the respective side of the step member. Each trackway may receive and guide guide members which are supported on upstanding portions of the step member immediately below whereby horizontal movement of the latter is guided by the trackways of the former.

Another object of this invention is to enable a single elongate flexible tension member to be used in an extension/retraction system without slackness thereof being a problem.

According to another aspect of this invention, a retractable stairway comprises movable step members which are arranged to form a stairway in one configuration and which are movable to and from another configuration. Each movable step member has guide members mounted in it. An elongate flexible member is anchored at either end in one of the movable step members. The flexible member is led from one of those anchorages through each movable step member in turn, being guided round at least one guide member on each step member, alternately clockwise and anti-clockwise round each successive guide member and then being led back through each movable step member to the other anchorage, being guided around at least one other guide member on each step member alternately clockwise and anti-clockwise round each successive guide member, Reversible driving means are provided for exerting a pull on the elongate flexible member in either direction. The arrangement is such, that when the step members form the stairway and the elongate flexible member is driven in one sense, the step members will be moved horizontally to the other configuration, whereas, when the step members are in that other configuration and the elongate flexible member is driven in the opposite senses the step members will be moved horizontally to form the stairway. The guide members which guide the elongate flexible member as it emerges from one of the step member and enters the adjacent step member may be arranged so that it follows a substantially horizontal path in so doing.

BRIEF DESCRIPTION OF DRAWINGS

Two forms of a combined stairway and lift installation which embodies this invention, and a modification of one of these forms will be described now, by way of example, with reference to the accompanying drawings, of which:

FIG. 1 shows structure (10) forming a horizontal surface (11) and an upright wall (12). The structure (10) may be part of a building or may be a separate housing for installation in structure of a building.

BRIEF DESCRIPTION OF THE INVENTION

Figure 1:
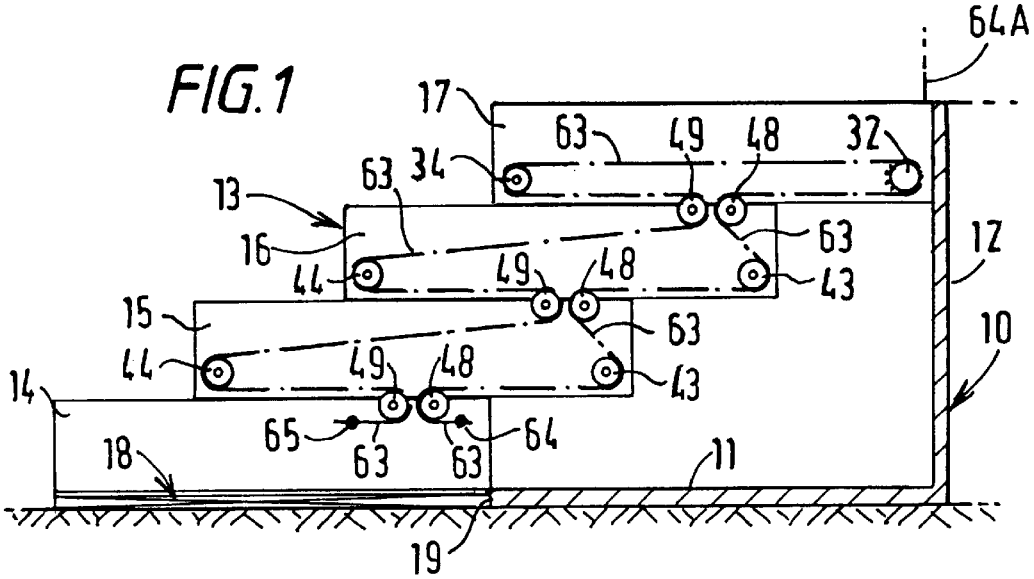
FIG. 1 is a diagrammatical representation of one of the installations which has a single drive chain, the lift being retracted and covered by the stairway.

A stairway (13) leads from the surface (11) to the top of the wall (12) and comprises a stack of four generally, rectangular step members (14 to 17). The bottom step member (14) has wheels whereby it is adapted for translational movement on the horizontal surface (11). The top step member (17) is mounted at the top of the wall (12) from which it projects horizontally. Each of the other two step members (15 and 16) is guided for horizontal movement on the step member (14, 15) immediately below it. Hence the stairway (13) is retractable from an extended condition, as shown in FIG. 1, to a retracted state as shown in FIG. 2.

Figure 2:
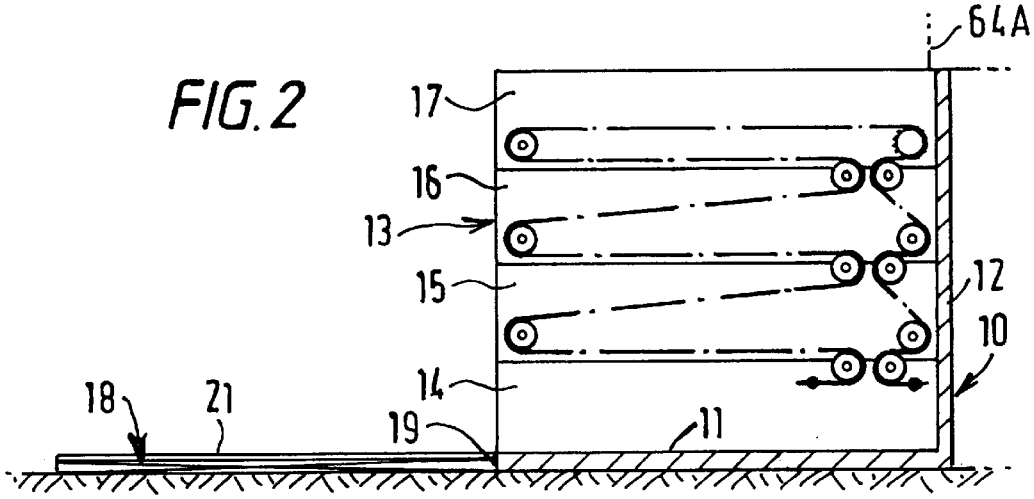
FIG. 2 is a view similar to FIG. 1 but showing the stairway withdrawn to uncover the lift.

A scissor lift (18) is installed in a cavity (19) in the structure (10), the cavity (19) being formed in the horizontal surface (11) so that it is exposed when the stairway (13) is retracted as shown in FIG. 2 whilst it is covered by the stairway (13) when the latter is extended as shown in FIG. 1. The lift (18) has a load carrying platform (21) which is flush with the surface (11) when the lift (18) is lowered.

Figure 3:
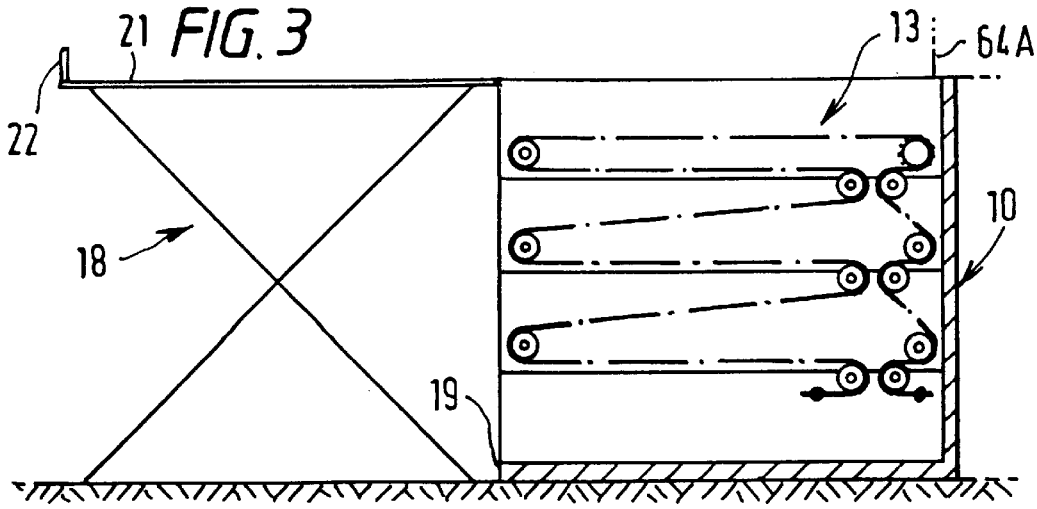
FIG. 3 is a view similar to FIG. 2 but showing the lift elevated.

FIG. 3 shows the lift (10) elevated. The load carrying platform (21) is flush with a tread surface formed by the top of the top step member (17). Also the platform (21) is close to the top step member (17) so that there is a minimal gap between them.

A movable stop (22) is provided at the end of the platform (21) remote from the top step member (17). The stop (22) is extended when the lift (18) is elevated, as shown in FIG. 3, so as to form a barrier against an object rolling off the elevated platform (21). The stop (22) is retracted when the lift (18) is lowered.

Figure 4:
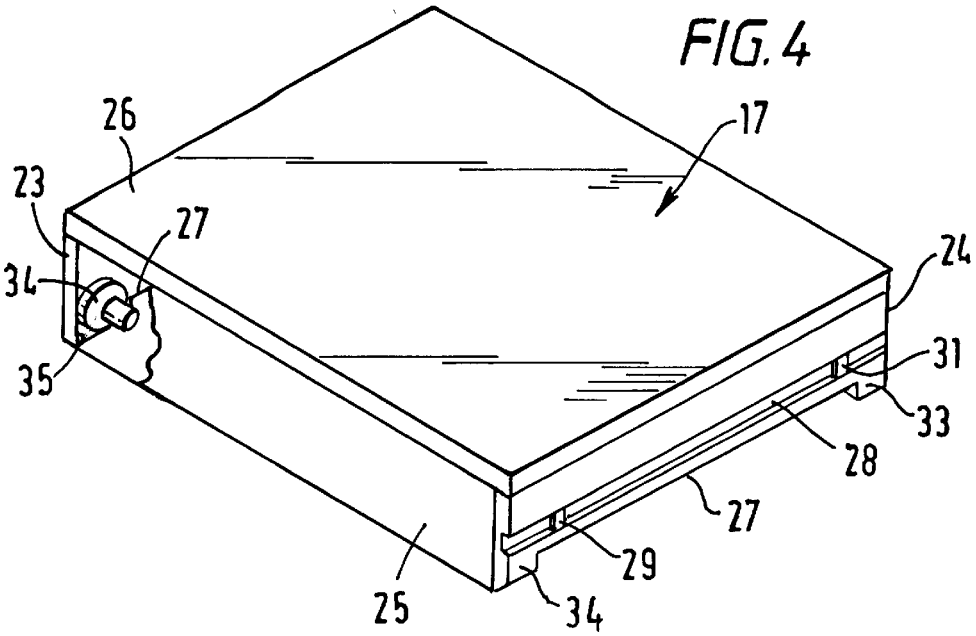
FIG. 4 is a perspective view of one form of top step member of the stairway of FIG. 1, part of the step member being broken away to reveal hidden detail.

FIG. 4 shows one form of top step member (17) which comprises a rectangular frame which forms a generally upright rear wall which is mounted on the wall (12), two generally upright side walls (23 and 24) and a front wall 25 which forms a riser portion of the step. The top of the frame is closed by a panel (26) which forms the tread surface of the step. The tread surface is flush with the top of the wall (12).

Each side wall (23, 24) is machined from solid. It has an elongate recess (27) formed in its lower edge between depending end portions (33 and 35). A groove (28) is formed in its outer surface so as to extend horizontally from end-to-end of that side wall (23, 24). Front and rear stop members (29 and 31) are fitted into the groove (28).

FIG. 1 shows a cog wheel (32) adjacent to the lower end of the rear wall of the top step member (17). A motor (not shown) which is mounted within the top step member (17) is drivingly coupled with the cog wheel (32). The latter is journalled on a spindle support which is mounted within the top step member (17) on the depending portion (33) of the side wall (23) that is formed at the end of the elongate recess (27) that is nearer to the rear wall of the frame. A roller (34) is similarly mounted within the top step member (17) on the depending portion 35 of the same side wall (23) that is at the other end of the elongate recess (27) adjacent to the front wall (25). The axes of symmetry of the cog wheel (32) and the roller (34) are parallel and lie in a substantially horizontal plane. The effective diameters of the roller (34) and the cog wheel (32) are substantially the same.

Figure 5:
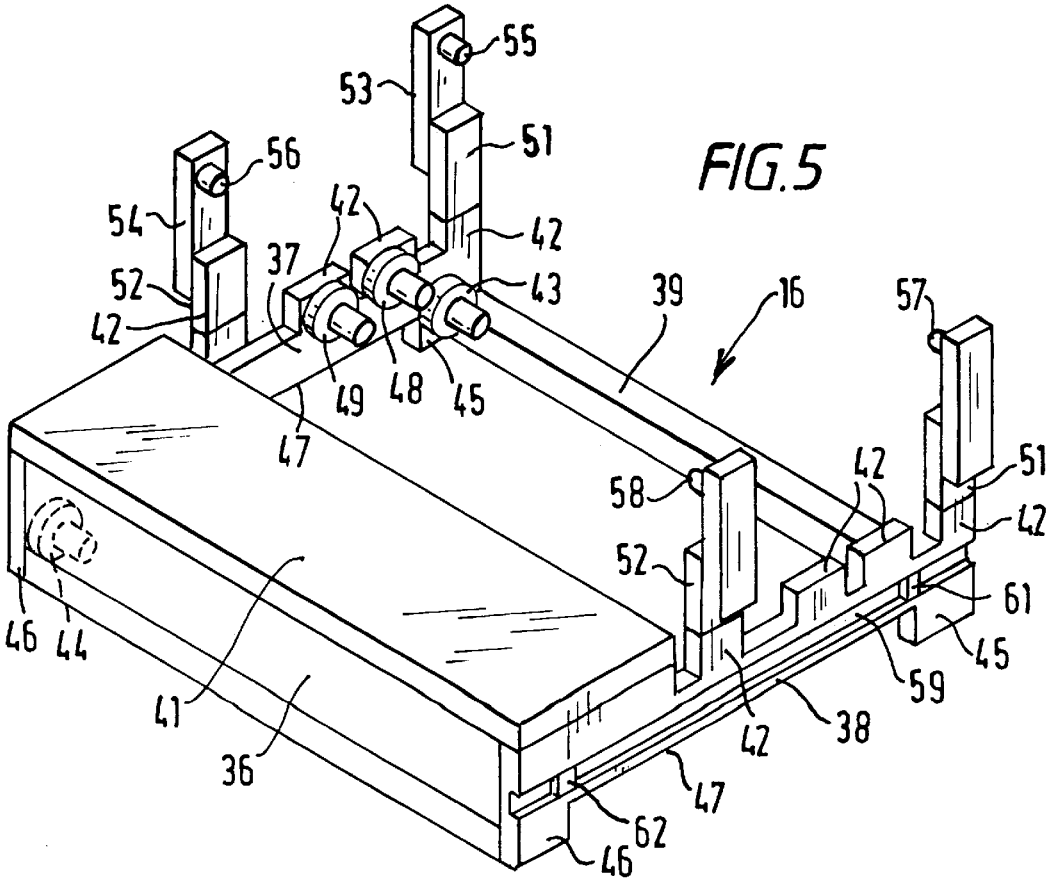
FIG. 5 is a perspective view of a movable step member for use with the top step member of FIG. 4 in the stairway of FIG. 1.

FIG. 5 shows the movable step member (16) which is similar to the movable step member (15). The stop member (16) comprises a rectangular frame having an upstanding front wall (36), which forms the riser portion of the step, two side walls (37 and 38) which are generally similar to the side walls (23 and 24) of the top step member (17) but which are modified as is described below, and a horizontal strengthening bar (39) at the rear. The part of the rectangular frame which projects beyond the front wall (25) of the top step member (17) when the stairway is extended as shown in FIG. 1 is covered by a panel (41) which forms the tread portion of the respective step member (16). The remainder of the top of the step member (16) is open as can be seen from FIG. 5.

Like the aide walls (23 and 24) of the top step member (17), the side walls (37 and 38) of the step member (16) are machined from solid. The differences between the side walls (37 and 38) and the side walls (23 and 24), are that, in order to reduce the weight, the uncovered upper edges of the side walls (37 and 38) are castellated to form four spaced upstanding castellations which serve as mounting portions (42).

Each of a pair of rollers (43 and 44) is mounted within the step member (16) on a respective one of the depending mounting portions (45 and 46) that is formed one at either end of the elongate recess (47) within the lower edge of the side wall (37) of the step member (16). As with the cog wheel (32) and the roller (34) of the top step member (17), the axes of symmetry of the rollers (43 and 44) are parallel and lie in a horizontal plane. Also their diameters are substantially the same. The middle pair of the four mounting portions (42) that are formed at the top of that aide wall (37) are above the respective recess (47) and thus are between the two rollers (43 and 44). A further roller (48, 49) is mounted within the step member (16) on each of that middle pair of mounting portions (42). Again the axes of symmetry of these further rollers (48 and 49) are parallel and lie in a horizontal plane. Also their diameters are substantially the same.

The outer pair of the four mounting portions (42) on the side wall (37) are each projected upwards. Each of these upward projections (51, 52) has a respective mounting plate (53, 54) secured face-to-face to its outer surface. Each mounting plate (53, 54) extends above the respective upward projection (51, 52) and carries a respective roller (55, 56) above that projection (51, 52). Another pair of rollers (57 and 5B) is similarly mounted on the outer pair of castellation mounting portions (42) that are formed by the upper edge of the other aide wall (38). The diameter of the rollers (55 to 58) are the same and their axes lie in a common horizontal plane.

The pairs of rollers (55 and 56, 57 and 58) on each side wall (37, 38) of the step member (16) extend into the groove (28) formed in the respective side wall (23, 24) of the top step member (17) between the respective stop members (29 and 31). Likewise the rollers (55 and 56, 57 and 59) of the similar step member (15) extend into the similar groove (59) that in formed in the respective side wall (37, 38) of the step member (16) and which has its own pair of stop members (61 and 62) one at either end. Hence horizontal movement of each of the step members (15 and 16) relative to the step member (16, 17) above is limited by the abutment of its rollers (55 to 58) with the respective front and rear stop members (29 and 31, 61 and 62) respectively of the step member (16, 17) above.

The bottom step member (14) is similar to each of the movable step members 15 and 16, except that it has no lower rollers (43 and 44), no lower elongate recesses (47) and is provided with wheels (not shown) on which it can move on the horizontal surface (11). Like the other movable step members (15 and 16), the bottom step member (14) carries rollers which run in the grooves (59) that are formed in the outer surfaces of the side walls (37 and 38) of the movable step member (15).

The front and rear stop members (29 and 31, 61 and 62) are spaced apart by the distance through which the respective step member (14 to 16) needs to be moved from the extended condition shown in FIG. 1 to the retracted condition shown in FIG. 2 so that the riser portions (25, 36) of the step members (14 to 17) are flush in the latter condition.

The lower and upper rollers (43, 44, 48 and 49) respectively of each movable step member (15, 16) are similarly positioned relative to the step members (15, 16) on which they are mounted, with the upper rollers (48 and 49) being positioned between the lower rollers (43 and 44) of a given step member (15, 16) in a direction along the length of its aide wall (37, 38). Each upper roller (48, 49) is mounted so that its highest point is nearly at the same level as the lower point of the lower rollers (43, 44) of the step member (15, 16) above for a reason which is explained below.

The length of the side walls (23, 24, 37, 38) of each step member (14 to 17) is substantially the same.

FIGS. 1 to 3 show that a chain (63) is fixed at either end (64, 65) in the bottom step member (14) and is guided in an undulating manner through the step members (14 to 17), around the rollers (43, 44, 48 and 49), the roller (34) and the cog wheel (32) with which it meshes. Starting from the and (65) that is the further from the wall (12), the chain (63) runs alternately anti-clockwise round the upper rollers (49) that are further from the wall (12), and clockwise round the adjacent lower rollers (44) in the step member (15, 16) above, until it reaches the top step member (17), where it winds clockwise round the roller (34) and clockwise round the cog wheel (32). From there, the chain (63) winds down the step members (16 and 15) again in an undulating manner, alternately anti-clockwise round the other upper rollers (48) and clockwise round the other lower rollers (43) to the bottom step (14), where it is fixed at its other end (64).

The tops of the upper rollers (48, 49) in a given step member (14 to 16) are nearly at the same level as the bottoms of the lower rollers (43 and 44) or the roller (34) and the cog wheel (32) in the step member (15 to 17) above, as described above so that the pair of portions of the chain (63) that extend therebetween are substantially horizontal. As a result, as the movable step members (14 to 16) are moved between the extended and retracted conditions shown in FIGS. 1 and 2, the length of one of the horizontal chain runs of each aligned pair increases by a certain amount whilst the length of the other reduces by the same amount. This leads to the chain (63) being taut from end (64) to end (65) through the range of movement of the movable step members (14 to 16) without there being a need to incorporate a tensioning device in the chain.

A retractable barrier (64A) is provided, optionally, at the top step member (17) to prevent people from trying to walk down the stairs when the steps (14 to 17) are in a retracted condition.

A control system is provided which Is operable to switch the motor on or off, as required in order to control movement of the movable step members (14 to 16). The control system can be activated using user control panels provided at both of the levels between which the stairway (13) extends.

When the step members (14 to 17) are extended to define the stairway (13) as shown in FIG. 1, the upper rollers (48 and 49) of each step member (14 to 16) are positioned approximately mid-way between the lower rollers (43 and 44) of the step member (15, 16) above, or mid-way between the roller (34) and the cog wheel (32) of the top step member. Also the front rollers (56, 58) of each moveable step (14 to 17) abut the front stop members (29, 62) of the step member (15 to 17) above.

When the stairway (13) is to be retracted from the condition shown in FIG. 1 to the condition shown in FIG. 2, the motor is energised to drive the cog wheel (32) anti-clockwise. That imparts a pulling force to the length of the chain (63) between the cog wheel (32) and the end (64) of the chain (63). As a result the chain (63) exerts a pull on each of the movable step members (14 to 16), through the respective upper roller (48) about which the chain (63) is drawn in an anti-clockwise sense, so that those step members (14 to 16) are pulled towards the wall (12).

This continues until the moveable step members (14 to 16) are fully retracted with their rear portions abutting the wall (12) and their riser portions (36) flush with that (25) of the top step member (17).

When the step members (14 to 16) are fully retracted, the length of the portion of the chain (63) that extends between the cog wheel (32) and the fixing point (64) is shorter than it was originally and the length of the portion of the chain (63) that extends between the cog wheel (32) and the fixing point (65) is correspondingly longer, as shown in FIGS. 2 and 3. Also the rear rollers (55 and 57) of each step member (14 to 16) abut the rear stop members (31, 61) of the step member (15 to 17) above.

In order to move the movable steps (14 to 16) back to their extended position, the motor is reversed to rotate the cog wheel (32) in the opposition direction, Hence a pulling force is applied to the chain (63) in a clockwise direction. As a result, the chain (63) exerts a pull away from the wall (12) on each of the movable step members (14 to 16) through the respective upper roller (49) about which the chain (63) is drawn in a clockwise sense, so that those movable step members (14 to 16) are pulled away from the wall (12). This movement continues until the front rollers (56 and 58) of each movable step members (14 to 16) abut the front stop members (29, 62) of the step members (15 to 17) above at which stage the stairway (13) is in its fully extended position.

When a person in a wheelchair wishes to move from the bottom of the stairway (13) to the top, the retractable barrier (64) in operated so that it extends from the top of the stairway (13), and the stairway is retracted as described above. This exposes the platform (21) of the lift (18), so that it can be mounted by the person on the wheelchair. The lift (18) can then be activated to raise the person to the outer level. When the lift (18) rises, the movable stop (22) rises relative to the platform (21) to prevent the wheelchair rolling off the lift. When the platform (21) is raised to the upper level, the barrier (64) is lowered and the wheelchair user can then move onto the upper level. When the lift (18) is no longer required, the platform (21) is lowered and the stairway (13) is then returned to its extended position again as described above.

While an embodiment of the invention has been described in which a single chain (63) is used, if necessary two such chains could be used one on each side of the stairway (13), one chain and its associated rollers and cog wheel being mounted on the side walls (37) as has been described above for the chain (63) whilst the other chain and its associated rollers and cog wheel would be similarly mounted on the other side wall (38). When two such chains are provided, they can each be driven by a single motor through a common axle on which the respective cog wheels are mounted. In such an arrangement, the motor may be arranged to drive the common axle through a separate cog wheel and drive chain.

The control system may be activated using a remote control device which could be fitted into the user control panel or could be fitted into a hand held device, or a key pad device, or any other suitable such control device.

It is difficult to achieve the desirable horizontal run of chain between each upper roller (49) and the respective roller (34 or 44) at the front end of the step member (15 to 17) above without that chain being dragged over the tread panel (41) of the respective step member (14 to 16) as the stairway (13) is extended or retracted. That would be undesirable as the material from which the tread panel (41) is formed is liable to be selected for aesthetic reasons and its appearance could be spoilt by damage due to the dragging of the chain over it. Another problem which follows from locating the roller (44) at the front of each movable step member (14 to 16) is that it will be below the tread panel (41) of that step member (14 to 16) and thus difficult to access for servicing.

Figure 6:
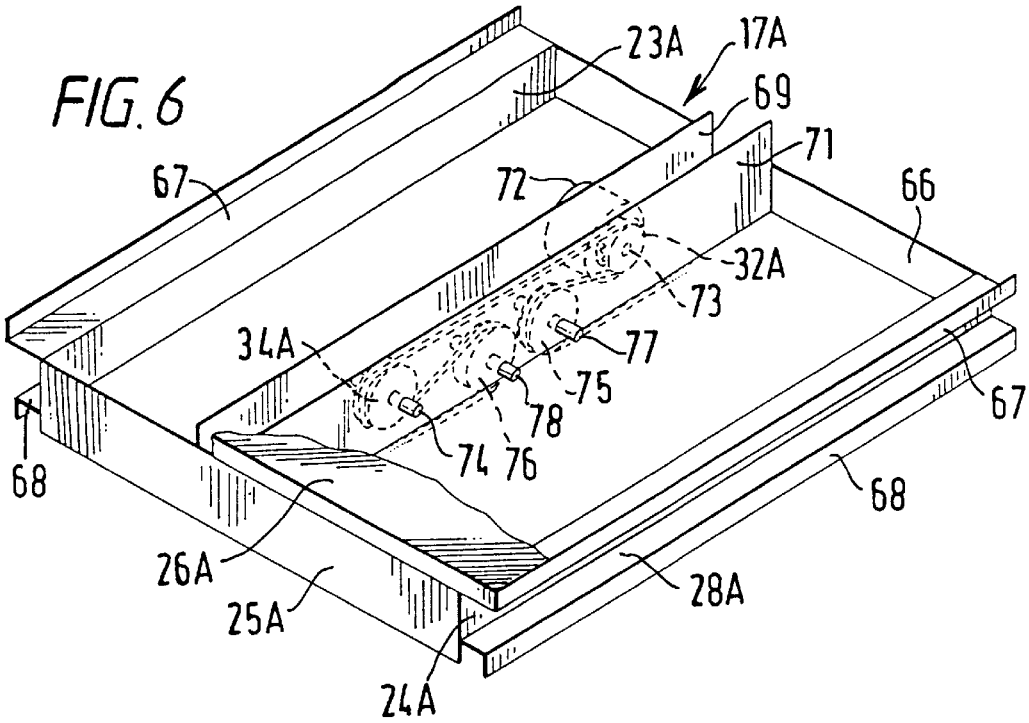
FIG. 6 is a view similar to FIG. 4 of a modified form of top step member for use in the stairway of FIG. 1.
Figure 7:
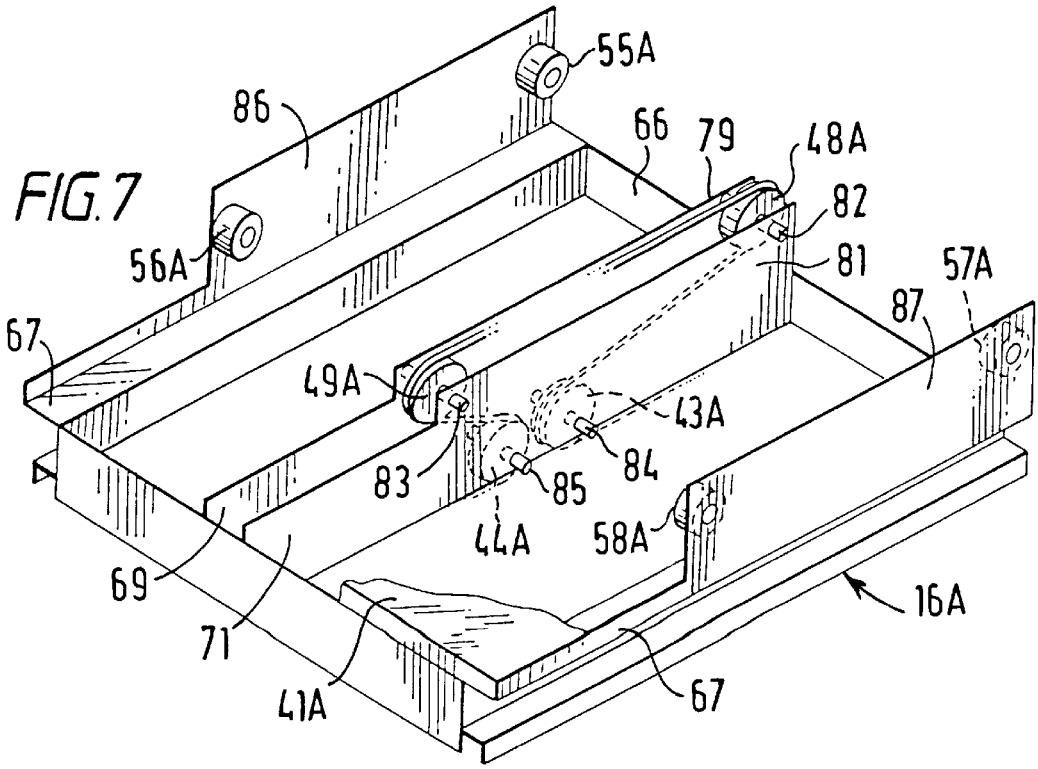
FIG. 7 is a view similar to FIG. 5 of a modified form of movable step member for use with the top step member of FIG. 6.

FIGS. 6 and 7 show other designs of step member for use in the stairway (13) in which the chain and rollers are arranged so as to avoid the problems discussed above.

Elements that are similar to corresponding elements of the step members shown in FIGS. 4 and 5 are identified by the same references with a suffix A.

FIG. 6 shows a top step member (17A) which is formed of sheet metal. Basically it comprises a sheet metal pressing in the form of a rectangular frame having upstanding sides which form the rear wall (66), the side walls (23A and 24A), and the front wall (25A) of the top step member (17A). The frame is covered by a panel (26A) which is shown broken away to reveal the interior and which forms the tread portion. Angled flanges (67 and 68) that run the length of the side walls (23A and 24A) respectively at the top and bottom of those side walls (23A and 24A), cooperate together to form a roller trackway (28A) which is similar to the groove (28).

A pair of parallel walls (69, 71), which are substantially parallel to the side walls (23A) and (24A) extend over the total length of the frame from the rear wall (66) to the front wall (25A), approximately midway between the side walls (23A and 24A). A motor (72) is mounted on the side of the wall (71) remote from the space between the walls (69 and 71). Its drive shaft (73) extends through the wall (71) and carries a cog wheel (32A) between the two walls (69 and 71). The drive shaft (73) is nearer the top of the wall (71) than the bottom thereof. A roller (34A) is journalled on an axle (74) which extends between the two walls (69 and 71) within which it is mounted. The axes of the drive shaft (73) and of the axle (74) are in the same horizontal plane. The roller (34A) is nearer to the front wall (25A) than is the cog wheel (32A) and it is spaced from the front wall (25A) by a distance which is a little greater than the distance between the front wall (25A) of the top step member (17A) and the front wall (36A) of the movable step member (16A) immediately below it when the stairway (13) is extended. Each of another pair of rollers (75 and 76) is journalled on a respective axle (77, 78) which extends between the two walls (69 and 71) within which it is mounted. The pair of rollers 75 and 76 are between and below the roller (34A) and the cog wheel (32A) and the axes of their axles (77 and 78) lie in the same horizontal plane. The diameters of the rollers (75 and 78) are the same.

FIG. 7 shows the movable step member (16A). It is a sheet metal pressing which is generally similar to the pressing that comprises the top step member (17A) described above with reference to FIG. 6. The differences are that the panel (41A) that forms the tread portion and that is shown broken away in FIG. 7, only covers the front portion of the top of the frame in the same way as does the panel (41) of the step member (16) shown in FIG. 5; and that the walls (69 and 71) and the upstanding portions of the upper angled flanges (67) are projected upwardly between the rear wall (66) and the rear end of the panel (41A).

Like the movable step member (16), the movable step member (16A) carries tour chain guide rollers (43A, 44A, 48A and 49A) but they are arranged differently. The pair of upper rollers (48A and 49A) are mounted between the upper projecting portions (79 and 81) of the walls (69 and 71), each on a respective axle (82, 83); one (48A) near to the rear of the portion (79 and 81) and the other (49A) near to the front thereof.

The tops of the rollers (48A and 49A) are at nearly the same horizontal level as are the bottoms of the lower rollers (75 and 76) of the top step member (17A) shown in FIG. 6 so that the chain (63A) follows a substantially horizontal path therebetween. The other pair of rollers (43A and 44A) are mounted between and below the upper pair of rollers (48A and 49A) on respective axles (64 and 85) that are mounted in and extend between the walls (69 and 71).

As with the arrangement described above with reference to FIGS. 1 to 5, the chain (63A) is fixed at either end in the bottom step member and is guided in an undulating manner through the stop members, around the rollers and the cog wheel (32A) with which it meshes. Starting from the end of the chain (63A) that is further from the wall (12), the chain (63A) runs clockwise round the upper roller (49A) that, in each step member, is further from the wall (12) and anti-clockwise round the adjacent lower roller (44A, 76) in the step member above, until it reaches the top step member (17A). There, having run anti-clockwise round the lower roller (76) that is the further of the lower rollers (75 and 76) from the wall (12), it runs clockwise round the roller (34A) and around the cog wheel (32A) which drives it. Then the chain (63A) runs anti-clockwise round the other lower rollers and clockwise around the other upper rollers of the step members below until its anchorage at its other end.

Each of the upstanding portions (86 and 87) of the upper angled flanges (67) carries a pair of rollers (55A and 56A, 57A and 58A) on its inner surface. These rollers (55A, 56A, 57A, 58A) run in the respective trackway (28A) of the top step member (17A) in a similar manner to that described above for the movable step members (14 to 16) of FIGS. 1 to 5.

It follows that the rollers of the step members (16A and 17A) are accessible from above when the stairway is retracted and the top panel (26A) is removed.

Figure 8:
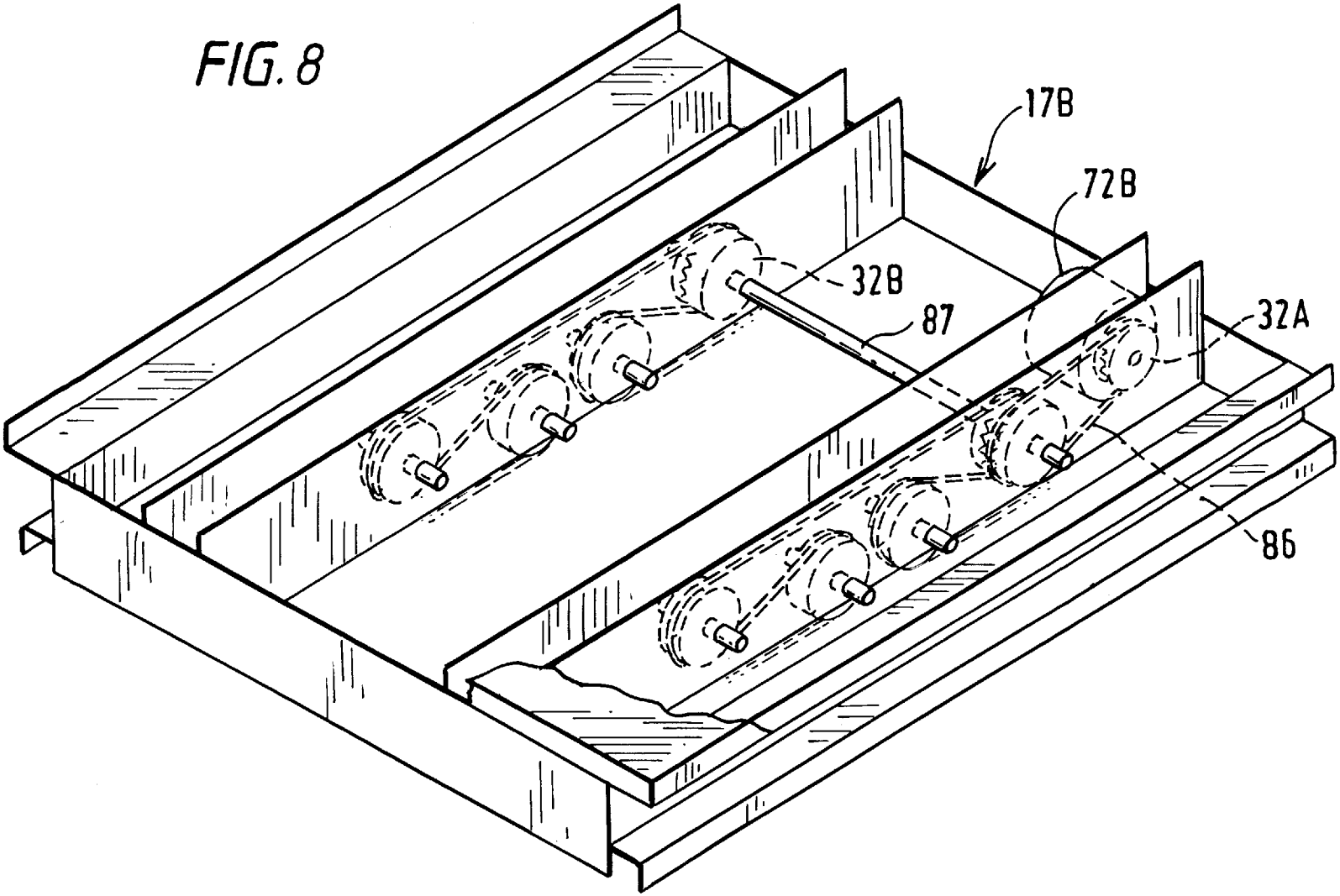
FIG. 8 is a view similar to FIG. 6 of the top step member of the other installation which has a twin drive chain arrangement driven by a common motor.

FIG. 8 shows a top step member (17B) which differs from that shown in FIG. 6 by being a twin chain arrangement, each of the two chain arrangements being similar to that described above with reference to FIGS. 6 and 7.

The motor (72B) drives the cog wheel (32A) of one of the chain drive systems through a separate drive chain (86). That cog wheel (32A) and the cog wheel (32B) of the other chain drive systems are mounted on a common axle (87) by which the drive is transmitted to the cog wheel (32B).

I claim:

1. A combined stairway and lift installation, comprising movable step members which are arranged in a first configuration to form a stairway when the lift is installed in a cavity at one level and which are movable into a second configuration when the lift is operated to be at another level, wherein the improvement comprises the stairway being formed over the lift when the lift is lowered into the cavity, and the step members being movable horizontally to and from said second, retracted configuration in which they are displaced to one side of the lift so that said lift is exposed and free to be raised.

2. A combined stairway and lift installation according to claim 1, wherein each movable step member has a front and rear and the length of each of the step members from their front to their rear is the same so that their front portions are flush in said second configuration.

3. A combined stairway and lift installation according to claim 1, wherein each movable step member has guide members mounted in it and an elongate flexible member is anchored at either end in one of the movable step members, the flexible member being led from one of those anchorages through each movable step member in turn, being guided round at least one guide member on each step member alternately clockwise and anti-clockwise round each successive guide member and then being led back through each movable step member to the other anchorage, being guided around at least one other guide member on each step member alternately clockwise and anti-clockwise round each successive other guide member, and wherein reversible driving means are provided for exerting a pull on the elongate flexible member in either direction, the arrangement being such that, when the step members form the stairway and the elongate flexible member is driven in one sense, the step members will be moved to said second configuration, whereas, when the step members are in said second configuration and the elongate flexible member is driven in the opposite sense, the step members will be moved to form the stairway.

4. A combined stairway and lift installation according to claim 3, wherein the guide members which guide the elongate flexible member as it emerges from one of the step members and enters the adjacent step member are arranged so that it follows a substantially horizontal path in so doing.

5. A combined stairway and lift installation according to claim 3, wherein each step member other than the top step member, has front, side and rear walls which form a rectangle, the front wall serving as a riser portion of the respective step when the stairway is formed and a part of the top which extends rearwards from the front being covered by a panel which serves as a tread portion of the respective step when the stairway is formed, the remainder of the top of the rectangle extending from the panel to the rear wall being open, and wherein each guide member mounted within the step member is mounted below the open remainder of the top.

6. A combined stairway and lift installation according to claim 5, wherein the guide members for the elongate flexible member that are mounted in each step member other than the bottom one, comprise two-pairs arranged one pair above the other, the lower pair being between the upper pair when viewed from above.

7. A combined stairway and lift installation according to claim 3, wherein said elongate flexible member is one of a pair of such elongate flexible members, the other elongate flexible member being similarly anchored at either end and being similarly led and guided through each movable step member, wherein common reversible driving means are provided for exerting a pull on both the elongate flexible members in either direction.

8. A combined stairway and lift installation according to claim 3, wherein said reversible driving means comprise a motor, the or each elongate flexible member comprises a chain and one of the guide members for the or each chain comprises a cog wheel which meshes with the respective chain, the motor being operable to drive the or each cog wheel.

9. A combined stairway and lift installation according to claim 7, wherein wherein said reversible driving means comprise a motor, the or each elongate flexible member comprises a chain, and one of the guide members for the or each chain comprises a cog wheel which meshes with the respective chain, the motor being operable to drive the or each cog wheel and the cog wheel for each chain is mounted on a common axle which is drivingly coupled with the motor through a separate drive belt.

10. A combined stairway and lift installation according to claim 1, wherein each step member has parallel side walls which form horizontal trackways which extend over a major part of the length of the respective side of the step member, each trackway receiving and guiding guide members which are supported on upstanding portions of the step member immediately below whereby horizontal movement of the latter is guided by the trackways of the former.

11. A retractable stairway comprising movable step members which are arranged to form a stairway in one configuration and which are movable to and from another configuration, wherein the improvement comprises each movable step member having guide members mounted in it and an elongate flexible member is anchored at either end in one of the movable step members, the flexible member being led from one of those anchorages through each moveable step member in turn, being guided round at least one guide member on each step member alternately clockwise and anti-clockwise round each successive guide member and then being led back through each movable step member to the other anchorage, being guided around at least one other guide member on each step member alternately clockwise and anti-clockwise round each successive other guide member, and wherein reversible driving means are provided for exerting a pull on the elongate flexible member in either directions the arrangement being such, that when the step members form the stairway and the elongate flexible member is driven in one sense, the step members will be moved horizontally to said another configuration, whereas, when the step members are in said another configuration and the elongate flexible member is driven in the opposite sense, the step members will be moved horizontally to form the stairway.

12. A retractable stairway according to claim 11, wherein the guide members which guide the elongate flexible member as it emerges from one of the step members and enters the adjacent step member are arranged so that it follows a substantially horizontal path in so doing.

13. A combined stairway and lift installation, comprising movable step members which are arranged in a first configuration to form a stairway when the lift is at one level and which are movable into a second configuration when-the lift is operated to be at another level, wherein the improvement comprises the stairway being formed over the lift when the lift is lowered, and the step members are movable horizontally to and from said second configuration in which they are displaced to one side of the lift so that said lift is exposed and free to be raised.

* * * * *

UNITED STATES PATENT AND TRADEMARK OFFICE

CERTIFICATE OF CORRECTION

PATENT NO. : 6,050,366

DATED : April 18, 2000

INVENTOR(S) : Charles Thomas Lyons

It is certified that error appears in the above-identified patent and that said Letters Patent is hereby corrected as shown below:

In column 1, line 24, please delete "Summary of the Invention".

In column 1, line 53, please insert --Summary of the Invention--.

In column 1, line 55, please change "apace" to --space--.

In column 3, line 11, please change the comma to a period.

In column 3, line 19, please change "senses" to --sense,--.

In column 3, line 54, please insert --Brief Description of the Invention--.

In column 3, line 58, please delete "Brief Description of the Invention".

In column 3, line 61, please delete the comma.

In column 4, line 11, please change "10" to --18--.

In column 4, line 52, please change "stop" to --step--.

In column 4, line 65, please change "aide" to --side--.

In column 5, line 15, please change "aide" to --side--.

In column 5, line 29, please change "5B" to --58--.

In column 5, line 31, please change "aide" to --side--.

In column 5, line 38, please change "59" to --58--.

In column 5, line 40, please change "in", first occurrence, to --is--.

UNITED STATES PATENT AND TRADEMARK OFFICE

CERTIFICATE OF CORRECTION

PATENT NO. : 6,050,366

DATED : April 18, 2000

INVENTOR(S) : Charles Thomas Lyons

It is certified that error appears in the above-identified patent and that said Letters Patent is hereby corrected as shown below:

In column 6, line 3, please change "aide" to --side--.

In column 6, line 44, please change "Is" to --is--.

In column 6, line 56, please change "stop" to --step--.

In column 7, line 16, please change the comma to a period.

In column 7, line 30, please change "in" to --is--.

In column 8, line 64, please change "tour" to --four--.

In column 9, line 10, please change "64" to --84--.

In column 9, line 15, please change "stop" to --step--.

In column 10, line 41, please delete the hyphen.

In column 10, line 60, please delete "wherein", second occurrence.

In column 12, line 1, please change "directions" to --direction--.

In column 12, line 17, please delete the hyphen.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*